United States Patent [19]

Barrett

[11] 4,167,811

[45] Sep. 18, 1979

[54] FOLDING KNIFE

[75] Inventor: Edward C. Barrett, Yorkshire, England

[73] Assignee: Imperial Knife Associated Companies, Inc., Providence, R.I.

[21] Appl. No.: 885,573

[22] Filed: Mar. 13, 1978

[51] Int. Cl.[2] ..... B26B 1/04

[52] U.S. Cl. ..... 30/161

[58] Field of Search ..... 30/160, 161, 156, 157

[56] References Cited

U.S. PATENT DOCUMENTS 684,016 10/1901 Weidknecht ..... 30/161

FOREIGN PATENT DOCUMENTS 2142258 1/1973 France ..... 30/161

*Primary Examiner*—Jimmy C. Peters

*Attorney, Agent, or Firm*—Kirschstein, Kirschstein, Ottinger & Cobrin

[57] ABSTRACT

A folding knife featuring a locking sleeve at the junction between the blade and handle, so that the knife blade may be locked in both the open and closed positions. The locking sleeve has an enlargement which accommodates the end of the blade adjacent the tang, so that the locking sleeve may be partially rotated when the knife is closed and at least the sharp edge portion of the blade is within a recess in the handle, whereby the blade is restrained from egress from the handle. Suitable structure is provided to prevent axial sliding movement of the locking sleeve off of the end of the handle.

6 Claims, 12 Drawing Figures

FOLDING KNIFE

BACKGROUND OF THE INVENTION

1. Field of the Invention

A folding knife.

2. Description of the Prior Art

Knives in which one end of the blade is pivotally mounted to one end of the handle have been known for many years. The purpose of such a pivotal mounting is so that the knife blade may be folded into a recess in the handle, thus precluding accidents due to exposure of the sharp edge of the blade when the knife is not in use. Thus foldable knives such as pocket knives have evolved in design with various means being suggested to prevent unintentional exiting of the blade from the recess or slot in the handle. Thus the prior art has developed pocket knives with a back spring to hold the blade in position in the recess in the handle when not in use. Prior art on this configuration includes U.S. Pat. Nos. 589,738; 1,476,030; 1,828,121; 1,852,399; 1,942,220; 1,969,100; 2,010,744 and 2,162,654; and British Pat. No. 1,001,540.

SUMMARY OF THE INVENTION

1. Purposes of the Invention

It is an object of the present invention to provide an improved knife.

Another object is to provide an improved folding knife.

A further object is to provide a folding knife in which the blade is effectively retained in a longitudinal recess or slot in the knife handle when the knife is folded.

An additional object is to provide a folding knife which cannot be accidentally opened.

Still another object is to provide a folding knife with integral locking sleeve to prevent accidental opening of the closed knife.

Still a further object is to effectively retain the pivoted blade of a folding knife in the closed position.

An object is to prevent the accidental exposure of the sharp edge of the blade of a folding knife when closed.

An object is to provide a folding knife with integral means for keeping the knife closed when folded.

An object is to provide an inexpensive and foolproof folding knife which cannot be accidentally opened when closed.

An object is to prevent persons from accidentally cutting themselves with a supposedly closed folding knife by providing such a knife which is not openable when once closed except by a conscious effort of adjusting a locking sleeve.

These and other objects and advantages of the present invention will become evident from the description which follows.

2. Brief Description of the Invention

In the present invention, the improved folding knife includes various elements including a blade, a handle, and a transverse pivot axle. The tang end of the blade is pivotally mounted to one end of the handle by means of the transverse pivot axle. A cylindrical locking sleeve is provided, and the one end of the handle is also cylindrical. The locking sleeve is rotatably mounted on the one end of the handle and has a longitudinal slot in its perimeter. The slot has an enlargement at the end portion of the slot which is spaced away from the pivot axle on which the blade is mounted. The enlargement in the slot includes a transverse edge which is generally parallel to the pivot axle, so that the end of the blade adjacent the tang of the blade contacts the transverse edge when the knife is closed and the locking sleeve is partially rotated. The handle has a longitudinal recess in which the blade is disposed when the knife is closed. Means are provided to prevent axial sliding movement of the locking sleeve.

In a preferred embodiment, the enlargement of the slot is generally rectangular, so that the slot including the enlargement is generally L-shaped. The edge in the enlargement of the slot is preferably a camming surface, i.e., an edge or surface offset slightly from a perpendicular orientation to the balance of the slot.

The means to prevent axial sliding movement of the locking sleeve typically includes a lateral detent portion of the locking sleeve, and at least one protuberance in the one end of the handle. The protuberance extends into the detent, to effectively inhibit axial sliding movement of the locking sleeve while permitting at least partial rotation of the locking sleeve on the one end of the handle. The detent is usually circular and extends about the entire perimeter of the locking sleeve.

The edges of the end of the locking sleeve, at the end of the slot spaced away from the handle, are preferably provided with camming surfaces adjacent the slot, so that when the knife is opened and the blade extends rectilinearly away from the handle, the subsequent rotation of the locking sleeve to secure the blade in the open position is effectively cammed.

The knife typically includes a groove or grooves on the surface of the blade adjacent the back edge of the blade, so that the blade may be manually manipulated out of the longitudinal recess in the handle by using a fingernail, when the entire slot per se is aligned with the blade by rotation of the locking sleeve. In addition, in the usual configuration, the pivot axle extends through the tang of the blade.

Typically the handle is composed of wood or plastic such as an acrylic resin, e.g., methyl methacrylate, bakelite, nylon, a phenolic resin, an epoxy resin, styrene, or the like, or of other material of diminished structural toughness or tensile strength compared to a metal such as steel, wrought iron, stainless steel, aluminum or brass. In this case a cylindrical restraining sleeve composed of a metal such as one of the metals mentioned supra will usually be provided. The restraining sleeve is mounted on the one end of the handle coaxially and concentrically within the locking sleeve. The restraining sleeve when provided will have a slot in registration with the slot in the locking sleeve. Typically in this case, the ends of the pivot axle are mounted in the restraining sleeve.

The present improved folding knife provides several salient advantages. The blade is effectively retained in a longitudinal recess or slot in the knife handle when the knife is folded. Thus the present folding knife cannot be accidentally opened, and accidents such as persons cutting themselves with the prior art knives thinking that the knife is closed when actually it is openable, are effectively prevented. The integral locking sleeve effectively prevents inadvertent accidental opening of the knife when once closed and set in the locked position. Thus the pivoted blade of the folding knife is effectively retained in the closed position, and the accidental baring or exposure of the sharp edge of the blade of the folding knife is completely prevented. The means for keeping the knife closed when folded are integral with the knife. Thus an inexpensive and foolproof folding knife is provided, which cannot be accidentally opened when closed, and is only openable by a conscious effort of adjusting a locking sleeve. The blade of the present folding knife may be effectively and completely locked in both the open and closed positions, thus precluding accidental dislodging of the blade from a given position.

The invention accordingly consists in the features of construction, combination of elements and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
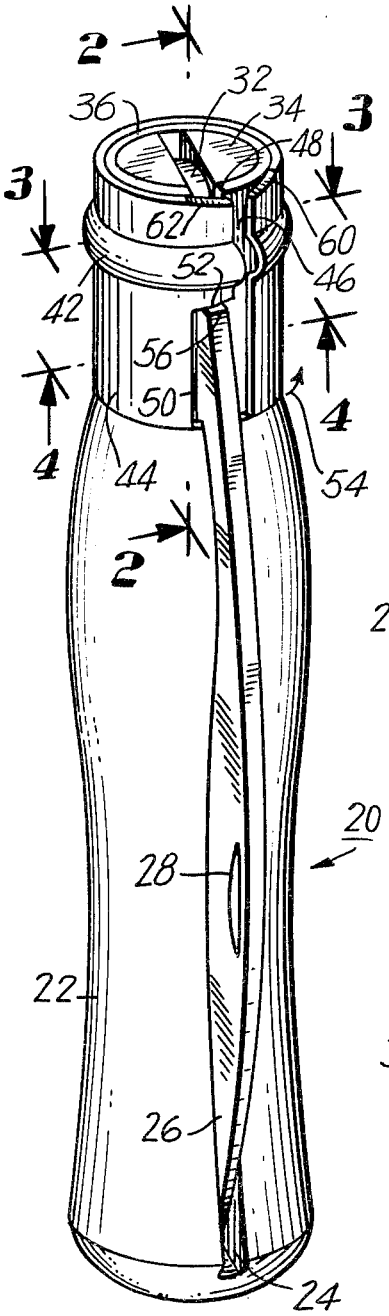
FIG. 1 is a perspective view showing the present folding knife in closed disposition.
Figure 2:
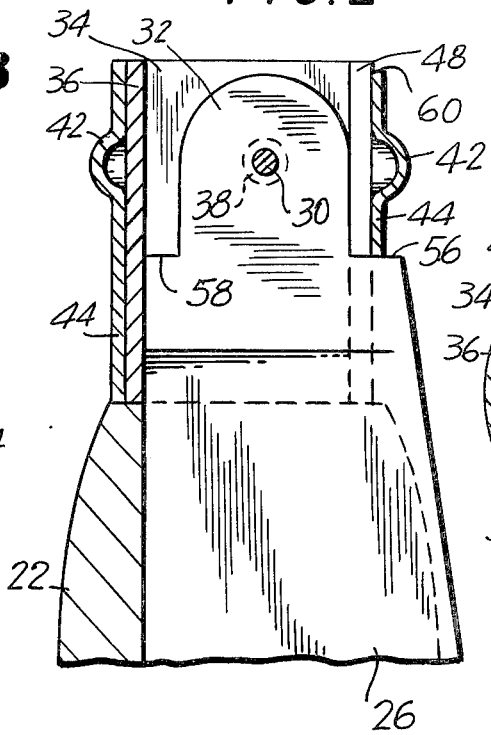
FIG. 2 is a sectional elevation view taken substantially along the line 2—2 of FIG. 1.

Referring now to FIGS. 1, 2, 3 and 4, a knife 20 is shown in closed and locked disposition. The knife 20 includes a handle 22 having a longitudinal recess or slot 24 in which a blade 26 is disposed. The blade 26 has a groove 28 on its face to accommodate a fingernail when it is desired to manually open the knife by pivoting the blade about pivot axle 30 which extends through tang 32 of the blade 26. As shown, the sharp edge of the blade 26 is within the handle 22.

Figure 3:
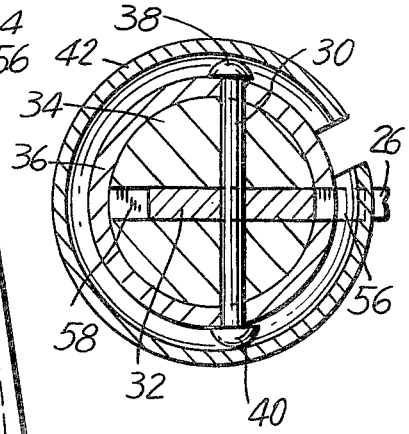
FIG. 3 is a sectional plan view taken substantially along the line 3—3 of FIG. 1.
Figure 5:
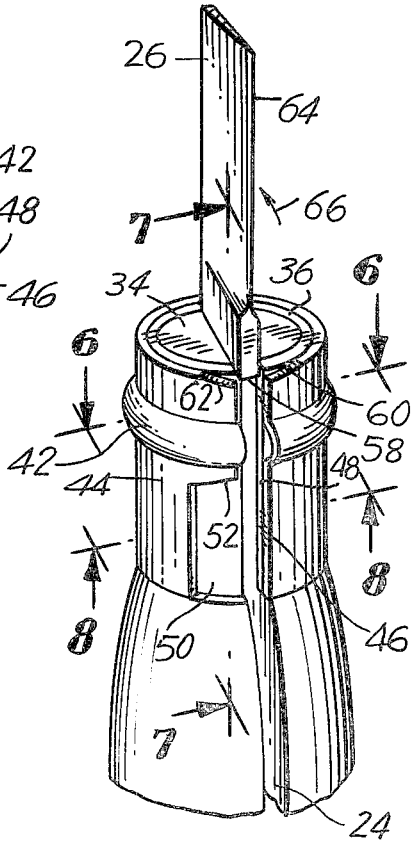
FIG. 5 is a partial perspective view of the present knife when initially opened.
Figure 6:
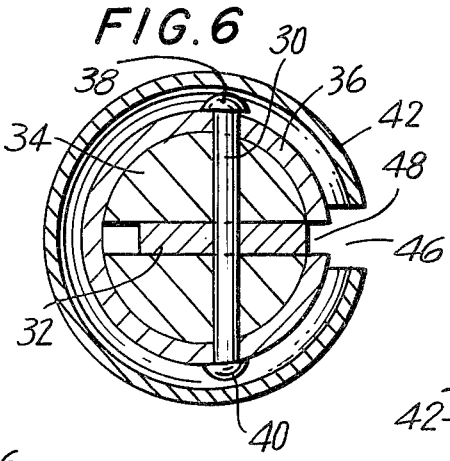
FIG. 6 is a sectional plan view taken substantially along the line 6—6 of FIG. 5.
Figure 4:
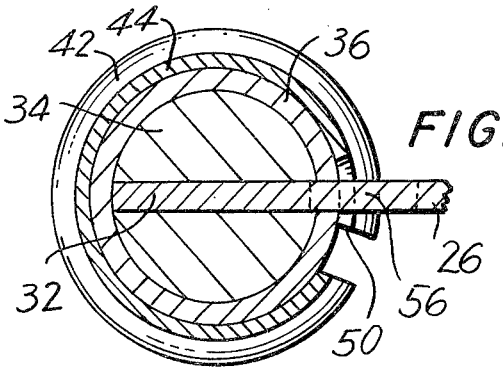
FIG. 4 is a bottom sectional plan view taken substantially along the line 4—4 of FIG. 1.
Figure 7:
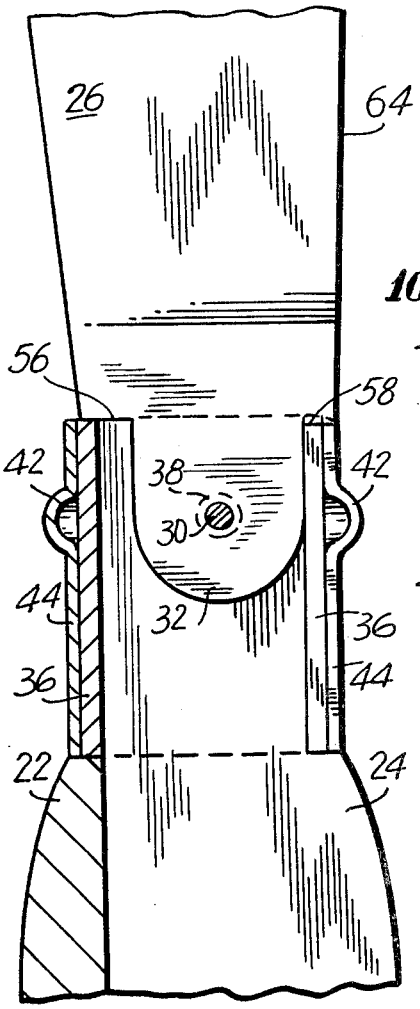
FIG. 7 is a sectional elevation view taken substantially along the line 7—7 of FIG. 5.
Figure 9:
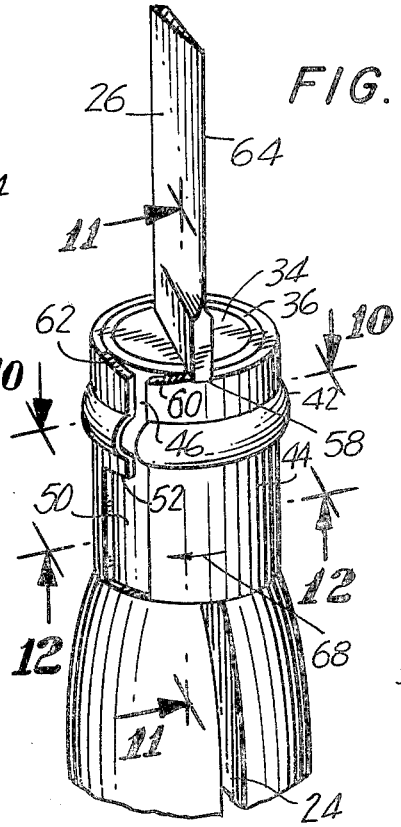
FIG. 9 is a partial perspective view of the present knife after opening and adjustment of the locking sleeve so that the knife is ready for service.
Figure 10:
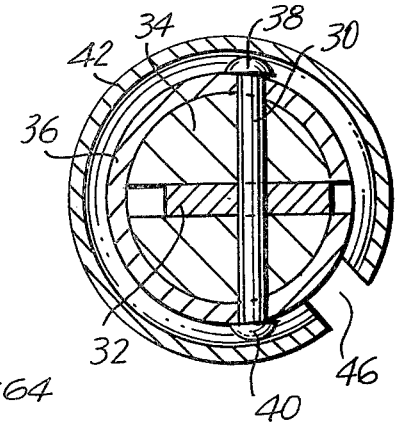
FIG. 10 is a sectional plan view taken substantially along the line 10—10 of FIG. 9.
Figure 11:
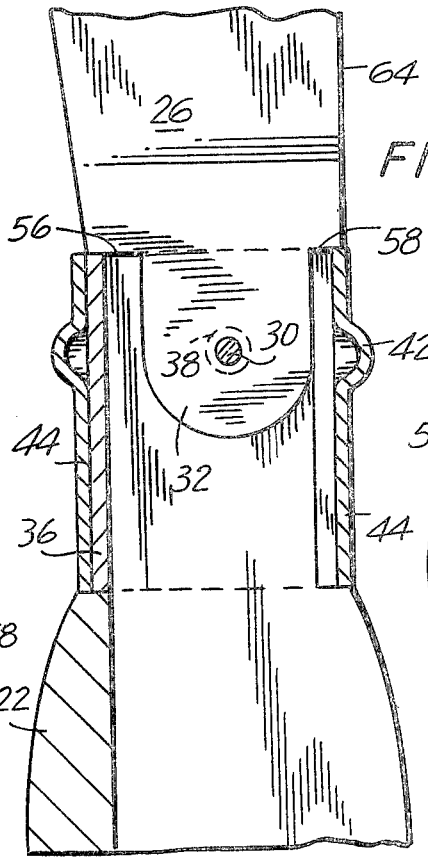
FIG. 11 is a sectional elevation view taken substantially along the line 11—11 of FIG. 9.
Figure 8:
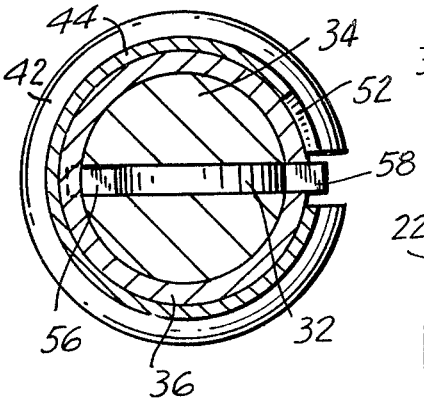
FIG. 8 is a bottom sectional plan view taken substantially along the line 8—8 of FIG. 5.
Figure 12:
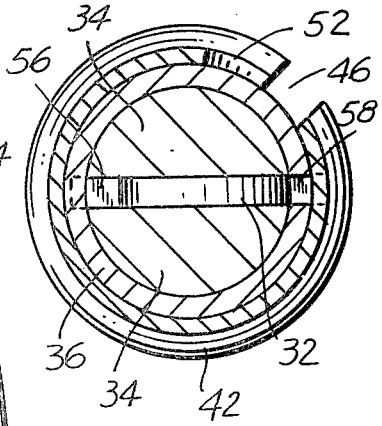
FIG. 12 is a bottom sectional plan view taken substantially along the line 12—12 of FIG. 9.

The transverse pivot axle 30 extends through the one end 34 of the handle 22 and is mounted at its ends in a cylindrical restraining sleeve 36 which is disposed about the one end 34 of the handle 22. The ends of the pivot axle 30 are provided with protuberances 38 and 40 which serve not only to hold pivot axle 30 in position but also which extend into an annular recess or detent 42 which is provided in an outer cylindrical locking sleeve 44. As best seen in FIG. 3 and 4, the one end 34 of handle 22, the restraining sleeve 36, the locking sleeve 44 and the circular recess or detent 42 are coaxial and concentrically oriented. The extension of the protuberances 38 and 40 into detent or recess 42 effectively prevents axial sliding movement of locking sleeve 44 while permitting manual rotation of the sleeve 44.

In accordance with the present invention, the locking sleeve 44 is provided with a longitudinal slot 46 which, as will appear infra, when in registration with a longitudinal slot 48 in restraining sleeve 36, permits pivotal movement of the blade 26 about pivot axle 30 and egress of the blade 26 from the longitudinal recess 24. In the present invention, the locking sleeve 44 is provided with an enlargement 50 of generally rectangular configuration and having an upper edge 52 which as shown is preferably a camming surface. The locking sleeve 44 has been partially rotated as indicated by arrow 54 so that the camming surface or edge 52 has cammed against edge 56 of the knife blade 26, thus effectively holding the blade 26 in the closed position and within longitudinal recess 24. It is apparent that blade 26 cannot move out of recess or slot 24 unless and until the locking sleeve 44 is manipulated by manual rotation to place slot 46 in registration with slot 48, at which time edge 52 will no longer be contiguous with edge 56. The tang end of the opposite sharp cutting edge of blade 26 is also provided with an edge 58 opposite to edge 56, which edge 58 cooperates with camming surfaces 60 or 62 when the knife 20 is opened, as will appear infra.

FIGS. 5, 6, 7 and 8 show how the blade 26 is initially disposed in the open position, so that sharp edge 64 is exposed. The blade 26 has been rotated about transverse pivot axle 30 in the direction indicated by arrow 66, and with slots 46 and 48 in registration, to accommodate this movement of the blade 26. It is evident that there is nothing in the FIGS. 5, 6, 7 and 8 disposition to prevent inadvertent closing of the blade 26 towards and into recess 24.

FIGS. 9, 10, 11 and 12 show the final orientation of elements with the blade 26 in the fully open position and with the knife ready for use. The locking sleeve 44 has been manipulated by manual rotation in the direction indicated by the arrow 68, so that camming surface 60 has cammed against edge 58 and the blade 26 is now locked in the open position by locking sleeve 44. The knife is now ready for use. After usage of the knife, an opposite sequence of movements of elements returns blade 26 to a locked position in recess 24.

It thus will be seen that there is provided a folding knife which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A folding knife comprising a blade, a handle, a transverse pivot axle, the tang end of said blade being pivotally mounted to one end of said handle by means of said transverse pivot axle, a cylindrical locking sleeve, said one end of said handle being cylindrical, said locking sleeve being rotatably mounted on said one end of said handle and having a longitudinal slot in its perimeter, said slot having an enlargement at the end portion of the slot which is spaced away from said pivot axle on which said blade is mounted, the enlargement in said slot including a transverse edge substantially parallel to said pivot axle, so that the end of said blade adjacent the tang of the blade contacts said edge when the knife is closed and said locking sleeve is partially rotated, said handle having a longitudinal recess in which said blade is disposed when the knife is closed, means to prevent axial sliding movement of said locking sleeve, said means including a lateral circular detent portion of said locking sleeve and at least one protuberance, said detent portion extending about the entire perimeter of said locking sleeve, said protuberance being at an end of said transverse pivot axle in the one end of said handle and extending into said detent portion, and a cylindrical restraining sleeve composed of metal, said handle being composed of a non-metal, said restraining sleeve being mounted on the one end of said handle coaxially and concentrically within said locking sleeve, said restraining sleeve having a slot in registration with the slot in said locking sleeve, the ends of said transverse pivot axle being mounted in said restraining sleeve.

2. The knife of claim 1 in which the enlargement of the slot is substantially rectangular.

3. The knife of claim 1 in which the edges of the end of the locking sleeve at the end of the slot spaced away from the handle are provided with camming surfaces adjacent the slot.

4. The knife of claim 1 in which the edge in the enlargement of the slot is a camming surface.

5. The knife of claim 1 in which the blade includes a groove on the surface of the blade adjacent the back edge of the blade.

6. The knife of claim 1 in which the pivot axle extends through the tang of the blade.

* * * * *